United States Patent [19]

Takeuchi et al.

[11] 4,440,661

[45] Apr. 3, 1984

[54] POWDERED CLEANING COMPOSITION

[75] Inventors: Shoji Takeuchi, Higashimurayama; Kozaburo Nishiyama, Fuchu; Tadashi Gomi, Fussa, all of Japan

[73] Assignees: Fuji Kasei Co., Ltd.; Yuho Chemicals Inc., both of Tokyo, Japan

[21] Appl. No.: 424,860

[22] Filed: Sep. 27, 1982

[30] Foreign Application Priority Data

Oct. 16, 1981 [JP] Japan ..... 56-164253

[51] Int. Cl.[3] ..... C11D 7/52

[52] U.S. Cl. ..... 252/89.1; 252/88; 252/155; 252/134; 252/174; 252/174.23; 252/DIG. 2

[58] Field of Search ..... 252/88, 89.1, 155, 134, 252/174, 174.23, DIG. 2, DIG. 14; 134/7; 51/298; 524/35, 510, 538

[56] References Cited

U.S. PATENT DOCUMENTS

| | | | |
|---|---|---|---|
| 3,910,848 | 10/1975 | Froehlich et al. | 252/DIG. 2 |
| 3,956,158 | 5/1976 | Donaldson | 252/155 |
| 3,957,700 | 5/1976 | Ferriday et al. | 524/35 |
| 3,957,701 | 5/1976 | Cutler et al. | 524/35 |
| 4,013,594 | 3/1977 | Froehlich et al. | 252/DIG. 2 |
| 4,184,973 | 1/1980 | Shaw | 252/174.23 |
| 4,284,759 | 8/1981 | Henbest et al. | 524/35 |

*Primary Examiner*—John E. Kittle
*Assistant Examiner*—Hoa Van Le
*Attorney, Agent, or Firm*—Oblon, Fisher, Spivak, McClelland & Maier

[57] ABSTRACT

A powdered cleaning composition comprising a carrier comprised of an organic fiber having a length of from 110 to 1000 microns and an amino-aldehyde resin, and adsorbed in said carrier at least one surfactant and water, is disclosed.

14 Claims, No Drawings

POWDERED CLEANING COMPOSITION

BACKGROUND OF THE INVENTION

1. Field of the Invention:

This invention relates to dry materials for cleaning carpets, other textiles, leather, tile and mortar, etc.

2. Description of the Prior Art:

Various methods for cleaning in the dry state and the cleaning materials, therefore, have been developed and marketed widely in recent years. These methods and materials include, for example, floor sweeping composition as well as powdered cleaning compositions for floor coverings such as rugs, carpets, etc. Exemplary of such cleaning compositions are floor sweeping compositions such as are disclosed in Mills et al, U.S. Pat. No. 3,533,953, which include a finely divided solid material such as sand, sawdust or salt, a wetting agent such as petroleum oil and an atactic propylene polymer. Such floor sweeping compositions generally are used to prohibit settled dust, dirt and fines from refloating in the air during the sweeping process, i.e., the wetting agent causes the finely particulate matter to adhere to the finely divided solid material of the sweeping composition. Cleaning compositions for carpets are exemplified by Froehlich et al, U.S. Pat. No. 4,013,594, which discloses a powdered cleaning composition comprising solid polymeric urea-formaldehyde particles of 10 to 105 microns in size and a solvent such as water, hydrocarbons, chlorinated hydrocarbons, alcohols and mixtures thereof. Such a composition is generally distributed into a carpet and subsequently removed by a vacuum cleaner. Such a composition generally operates by an adsorptive mechanism wherein an equilibrium is reached, over a period of time, as to the distribution of soil between a carpet and the cleaning particles.

However, a need continues to exist for improved cleaning compositions.

SUMMARY OF THE INVENTION

Accordingly, one object of the invention is to provide a powdered cleaning composition of improved cleaning efficiency.

Another object of the invention is to provide a powdered cleaning composition having less residual odor after cleaning.

A further object of the invention is to provide a powdered cleaning composition which aids the resistivity to re-soiling after cleaning.

Briefly, these objects and other objects of the invention, as hereinafter will become more readily apparent, can be attained by providing a powdered cleaning composition comprising a carrier comprised of an organic fiber having a length of from 110 to 1000 microns and an amino-aldehyde resin, and adsorbed in said carrier at least one surfactant and water.

DETAILED DESCRIPTION OF THE PREFERRED EMBODIMENTS

The use of dry materials for cleaning compositions for carpets, other textiles, leather, tile and mortar, etc. has become widespread in recent years. The word "dry" as used in this regard means that the composition will flow and can be handled as a powder, even though it may contain considerable amounts of a liquid such as water and organic solvents.

The dry materials of the present invention containing surfactant and water may be spread on a surface to be cleaned, e.g., carpet, rubbed into the carpet fibers, e.g., by a rotary brushing machine, dried for 20 to 30 minutes, and then removed from the carpet with soil adsorbed therein by means of a vacuum cleaner.

The carrier, used in the powdered cleaning composition of this invention, has a specific form and properties. The base material of the carrier is an organic fiber having a length of from 110 to 1000 microns. This is combined with a porous amino-aldehyde resin which is mixed with, stuck or coated on the surface of the fibers. The carrier, thus formed, has suitable hardness and coarseness, has an apparent specific gravity of 0.2–0.5 g/cc and a porosity of 100–300% as illustrated by maximum water content.

The carrier cosists essentially of about 50 to 80% amino-aldehyde resin and about 20 to 50% organic fiber considering the manner of combination and sticking each other of these materials. The preferable relative proportion, however, is 65 to 75% of amino-aldehyde to 25 to 35% of organic fiber from the all-round evalution of cleaning and self-filtering efficiency, and distribution and recovery of the cleaner. The carrier containing more than 50% of organic fiber is less effective in cleaning the materials to be cleaned and the carrier containing more than 80% of amino-aldehyde resin may cause the decrease of vacuum efficiency of the cleaner.

This form and properties of the carrier enable the polishing of soiled fibers or surfaces with a brushing machine and the mechanical removal of the soil with the carrier from the fibers of surface. The considerable amounts of water, surfactant, solvent or other additives, contained in the porous resinous substance, permeate into the soil stuck to the surface to be cleaned and solubilize, emulsify, disperse or adsorb soil effectively. Such properties allow the attainment of efficient cleaning.

A part of the porous amino-aldehyde resin combined with the organic fiber or coated on the surface thereof may crack during the brushing operation and/or be torn off the organic fiber. The cracked surface of the porous amino-aldehyde resin is hard enough and sharp enough to effectively polish carpet fibers but not damage the same.

The organic fibers, usually a flock, may wipe soil away from the surface being cleaned during brushing and act as a self-filter for a vacuum cleaner, since the individual fibers of a flock are intertwined with each other in the filter of a vacuum cleaner and do not block the mesh of the filter. Thus, vacuum efficiency will not decrease even when using a vacuum cleaner having a rather coarse mesh.

The carrier of the present invention is prepared by combining an amino-aldehyde resin, which is the condensation product of an amino compound with an aldehyde, with the organic fibers and/or by coating said fibers with the resin and then hardening the resin.

The principle of combining resin with fibers is known in the resin treatment of fibers. The components of resin permeate and disperse into the flock-micell, then harden and stick to the fibers. The OH radical of a fiber combines with aldehyde resin by ether linkage and the resin hardens and sticks simultaneously to the fibers when pulpflock is used as a fiber. The practicalmanner of combining a fiber with resin is described in the preparation of the carrier. The carrier, so produced, is in the form of a flock.

Suitable organic fibers which can be used to prepare the carrier of the present invention include polyvinyl alcohols (Vinylon), polyamides (Nylon), acrylic resins, cellulose (pulp flock) and regenerated cellulose (rayon).

Suitable amino compounds which can be used to prepare the amino-aldehyde resin include urea, melamine, dicyandiamide, ethylene urea, thiourea, benzoguanamine, guanidines, polyethylenepolyamines and m-phenylene diamines.

Suitable aldehydes which can be used to prepare the amino-aldehydes resin include formaldehyde, acetaldehyde, glyoxal and furfural.

Typically urea, melamine and formaldehyde are used in the preparation of the amino-aldehyde resin of the present invention.

Radicals having an ablity to adsorb and/or exchange anions or cations can be introduced into the amino-aldehyde resin. These radicals can deionize the liquid contained therein and improve cleaning efficiency by actions such as permeation of the surfactant into the soil and swelling, solubilizing, emulsifying, dispersing and adsorbing the soil. They can also modify the properties of the amino-aldehyde resin so as to adsorb ionized particles of the soil.

Amino compounds which are more basic than urea and melamine, such as guanidines, polyethylenepolyamines and m-phenylenediamine, can be used to modify the resin by increasing its ability to adsorb and/or exchange anions.

To improve the resin properties as to adsorbability and/or exchangeability of cations, conventional methods of trcatment can be used, e.g., methylol radicals in the amino aldehyde resin can be reacted with sodium bisulfite or sodium secondary phosphite or co-polycondensed with phenolsulfonic acid, naphthalenesulfonic acid or sulfonic acid.

The length of the organic fibers, used to prepare the carrier of the present invention, is from 110–1000 microns, and it is selected according to the material which is to be cleaned.

The diameter of the organic fibers can be established as desired to some extent, but when a pulp flock is used as a fiber, it is limited to a range of from 5μ to 35μ on an average according to the use cellulose. The diameter of the fibers used in preparing the carrier of the invention is preferably from 10μ to 20μ, taking into consideration of blocking of the filter due to intertwining of the fiber and the brushing, self-filtering and cleaning efficiencies of the carrier.

While the powdered cleaner of the present invention can be used widely for cleaning various materials such as carpet, other textile, mat, leather, and tile or motar, it is preferable to use fibers having a length of 110 to 500 microns for carpet, 220 to 700 microns for mat, and 300 to 1000 microns for vinyl tile or dressed mortar.

The surfactants contained in the powdered cleaning composition are selected for cleaning effectiveness, appearance and touch after cleaning and electrical insulation (reduction of static electricity) properties. Suitable surfactants can be anionic, cationic, nonionic or amphoteric.

Suitable anionic surfactants include sodium lauryl sulfate, sodium dodecyl benzyl sulfonate, ammonium laurylether sulfate, sodium alkyl naphthalene sulfonate and sodium lauryl sarcosinate.

Suitable cationic surfactants include distearyl dimethyl ammonium chloride, lauryl trimethyl ammonium chloride and cocoyl dimethyl benzyl ammonium chloride.

Suitable nonionic surfactants include nonylphenoxy polyethoxy ethanol, polyoxyethylene lauryl ether and sorbitan monolaurate.

Suitable amphoteric surfactants include lauryl betaine and 2-cocoyl-N-carboxymethyl-N-hydroxyethylimidazolium betaine.

At least one surfactant can be incorporated in the powdered cleaning composition, but co-existence of anionic and cationic surfactant in the composition should be avoided.

The surfactant is added to the carrier in an amount of 0.01 to 40 wt% by weight of the carrier, preferably 0.1 to 10 wt% by weight of the carrier.

Water is also present in the carrier in an amount of from 20 to 250 wt% by weight of the carrier, preferably from 50 to 100 wt% by weight of the carrier.

The surfactant is dissolved, emulsified or dispersed in water. The carrier is stirred separately in the mixer while the solution is dispersion of the surfactant is sprayed on the carrier and mixed uniformly.

Other additives may be incorporated into the carrier in a similar manner, such additives including conventional cleaning components such as builders, solvents, fluorescent dyes, enzymes, bleaching agents and germicides.

The representative compounds for these additives are listed as below:

Builders-sodium tripolyphosphate, tetrasodium pyrophosphate, sodium sesquicarbonate, sodium citrate and ethylenediamine tetra acetic acid tetra sodium salt.

Solvents-ethyleneglycol monobutyl ether, diethyleneglycol monobutyl ether, perchloroethylene and hydrocarbon solvent.

Fluorescent dyes
- Tinopal CBSX (prepared by CIBA GEIGY)
- Kayaphor WN (prepared by NIHON KAYAKU)

Enzyme
- Bioprase AL-15 (protease prepared by NAGASE SANGYO)
- Oriprase (lipase prepared by NAGASE SANGYO)

Bleaching agent-sodium percarbonate and sodium perborate.

Germicide
- Irgasan DP-300 (2,4,4'-trichloro-2'-hydroxydiphenyl ether, prepared by CIBA GEIGY)
- Hibitane (chlorohexidine, prepared by SUMITOMO CHEMICALS.)
- PCMX (p-chloro-m-xylenol, prepared by MITSUBISHI GAS CHEMICALS.)
- TCC (trichlorocarbonilide, prepared by MONSANTO.)

The apparent specific gravity and the maximum water content of the carrier were measured according to the methods as described below:

APPARENT SPECIFIC GRAVITY

Three grams of the dried carrier was placed in a cylinder (20 cc, 10 mm diameter) which was swung slightly to flatten the surface of the carrier. Graduation of cc on the cylinder was measured and the apparent specific gravity was calculated by the formula:

apparent specific gravity = 3/number of cc

MAXIMUM WATER CONTENT

Three grams of dried carrier was placed on the center of a dish and water was added to the carrier with a millipipette while stirring with a spatula to make putty.

The amount of water by weight, set forth as % by weight based on the weight of the carrier, to make putty was taken as the maximum water content.

The reaction condition in the resin preparation process affects delicately the maximum water content (porosity) of the formed resin. The reaction condition such as temperature of the reaction, mole ratio of urea to formaldehyde, period of the reaction, amount of the hardening agent and the manner of cooling the reaction mixture can be controlled in order to achieve a desired maximum water content of the carrier. The most important factor to control the porocity of the carrier is an amount of water to be used with the hardening agent. 50 to 200% of water based on the weight of urea and formaldehyde is required to obtain a carrier having maximum water content of 100 to 300%.

PREPARATION OF THE CARRIER

(1) Carrier A—suitable for cleaning carpets

Three hundred parts of urea and 600 parts of 37% formalin were put in a reaction vessel equipped with a strong stirrer and the pH of the mixture was adjusted to about 8. The reaction was carried out for 1 hour at a temperature of 60° C. Then 150 parts of pulp flock (cellulose), 200 to 500 microns long, was added to the reaction mixture and dispersed therein.

Seven parts of 95% sulfuric acid were diluted with 500 parts of water in a separate vessel, and the diluted sulfuric acid was poured into the reaction mixture. Heat was generated in a few minutes and the reaction of methylene formation proceeded vigorously. The reaction mixture was cooled slowly with stirring, neutralized with NaOH and filtered with water washing. After sufficient dehydration, 770 parts of flock-like carrier having a water content of 33.3% were obtained.

Five parts of sulfuric acid and 20 parts of sulfamic acid were diluted with 1500 parts of water in a separate vessel. The acid solution was poured into the reaction mixture. Heat was generated in a few minutes and the reaction for methylene formation proceeded vigorously. The mixture was cooled slowly, neutralized with NaOH, and, if required, crushed with a trituration type crusher. Then the mixture was filtered with water washing and dehydrated to obtain 1500 parts of flock-like carrier having a water content of 33.3%.

The characteristics of the carriers A and B are as follows:

| | A | B |
|---|---|---|
| Length of the flock (microns) | 100–500 | 200–700 |
| Apparent specific gravity | 0.32 | 0.38 |
| Maximum water content | 180 | 200 |
| Ion exchangeability | little | static ion exchangeability (0.1 mmol $Ca^{+}$/g) |

The static ion exchangeability is measured by the following method;

One gram of the sample (carrier) is dispersed in 500 cc of $Ca(OH)_2$ solution in water having an initial concentration of 100 mmol Ca/l and is left standing at a temperature of 30° C. until the concentration of Ca (mmol Ca/l) reaches equilibrium. The amount of Ca exchanged at the state of equilibrium is divided by 1 g of the sample. The divided value shows the static cationic exchangeability as mmol Ca/g.

COMPARATIVE TESTS

The formulations of powdered cleaners for comparative testing are shown in Table 1.

TABLE 1

| Sample | | Carpets 1 | 2 | 3 | 4 | 5 | 6 | Mats 7 | 8 | 9 | 10 | 11 | 12 |
|---|---|---|---|---|---|---|---|---|---|---|---|---|---|
| Carrier of the invention | Carrier A | 150 | | | 150 | | | | | | | | |
| | Carrier B (W.C. 33.3%) | | | | | | | 150 | | | 150 | | |
| Conventional | Particulate of aminoaldehyde* resin (W.C. 33.3%) | | 150 | | | 150 | | | 150 | | | 150 | |
| | Sawdust | | | 110 | | | 110 | | | 110 | | | 110 |
| Surfactant | Anion | 1.5 | 1.5 | 1.5 | 0.5 | 0.5 | 0.5 | 2 | 2 | 2 | 0.5 | 0.5 | 0.5 |
| | Nonion | 1.5 | 1.5 | 1.5 | 0.5 | 0.5 | 0.5 | 3 | 3 | 3 | 1 | 1 | 1 |
| Builder | Sodium tripolyphosphate | | | | 3 | 3 | 3 | | | | 2 | 2 | 2 |
| | EDTA-4Na | | | | 0.2 | 0.2 | 0.2 | | | | 0.1 | 0.1 | 0.1 |
| Solvent | Petroleum | | | | 5 | 5 | 5 | | | | 2.5 | 2.5 | 2.5 |
| Fluorescent dye | Tinopal CBSX | 0.05 | 0.05 | 0.05 | 0.05 | 0.05 | 0.05 | 0.05 | 0.05 | 0.05 | 0.05 | 0.05 | 0.05 |
| Enzyme | Bioprase | | | | 0.1 | 0.1 | 0.1 | | | | | | |
| Bleaching agent | Sodium percarbonate | | | | 1 | 1 | 1 | | | | | | |
| Germicide | Irgasan DP-300 | | | | 0.02 | 0.02 | 0.02 | | | | 0.02 | 0.02 | 0.02 |
| Water | | 20 | 20 | 20 | 12.68 | 12.68 | 52.68 | 18 | 18 | 58 | 16.38 | 16.38 | 56.38 |

W.C. indicates water content.
*indicates particulate having a diameter of 10~105μ

(2) Carrier B—suitable for cleaning mat

Six hundred parts of urea and 1100 parts of 37% formalin were put in a reaction vessel equipped with a strong stirrer, the pH of the mixture was adjusted to about 8 with NaOH. After reacting the mixture for 1 hour at a temperature of 65° C., 320 parts of pulp flock (cellulose), 300 to 700 microns long, were added to the mixture and well dispersed in the mixture.

When the water content of the carrier is out of the range of 20 to 250%, the composition may lose the balance of the components. Water content of more than 250% may impare a capability of distribution and less than 20% may decrease remarkably cleaning efficiency.

(1) Methods of measuring cleaning efficiency, distribution and recovery of the cleaner and evaluation of the cleaned materials after cleaning for carpet and mat 300×3000 mm of contract carpet (Nylon) CS-200-2 (gold) made by TORE Co., Ltd was set on the road for 30 days. There was about 5000 persons traffic on the road in a day. The carpet was divided into 10 parts of 300 mm×300 mm and the position of a part of the carpet was replaced every day one by one to ensure a random walking and an uniform polution on the carpet.

After uniform cleaning of the poluted carpet by a dry cleaner, 5 g each of samples 1 to 12 were spread uniformly on the carpet cut into 50×420 mm (2100 mm$^2$). The carpet was cleaned with Gardner straight line washability and abrasion (made by U.S. Gardner Laboratory Inc.). The weight of 500 g was laid on a pighair brush and the carpets were brushed and cleaned with the same condition by a single oscillation of 500 times/-sec. Recovery of the cleaner was measured by eyes and the cleaning efficiency was determined by a light reflectance method using Photoelectric reflectmeter TC-6D made by Tokyo Denshoku Co., Ltd.

(2) Uniform distribution of the cleaner and the capability of distribution of the cleaner The results of the tests are set forth in Table 2.

TABLE 2

| | Formulation | | | | | | | | | | | |
|---|---|---|---|---|---|---|---|---|---|---|---|---|
| | Carpet | | | | | | Mat | | | | | |
| Evaluation | 1 | 2 | 3 | 4 | 5 | 6 | 7 | 8 | 9 | 10 | 11 | 12 |
| Uniform distribution of the cleaner | U | U | S | U | U | S | U | U | S | U | U | S |
| Capability of distribution | E | G | I | E | G | I | E | G | I | E | G | I |

U—uniform distribution
S—separation of powder and liquid
E—excellent distribution
G—good distribution
I—distribution was impossible since the cleaner was sticky The test panel consisting of 10 persons having standard discerning eye evaluates the distribution of the cleaner. When more than 5 persons evaluate the distribution as good, the distribution is indicated as G and when more than 8 persons evaluate the distribution as good, it is indicated as E.

As to recovery of the cleaner, appearance and touch after cleaning, residual odor after cleaning and the degree of soil in one month after cleaning, they are evaluated also by the above described 10 persons. When more than 6 persons evaluate the item of the test as good, it is indicated as A. When 5 persons, 4 persons and less than 4 persons evaluate as good, it is indicated as B, C and D respectively.

(3) Recovery of the cleaner, cleaning efficiency and evaluation after cleaning

The result of the tests are set forth in Table 3.

TABLE 3

| | Formulation | | | | | | | | | | | |
|---|---|---|---|---|---|---|---|---|---|---|---|---|
| | Carpet | | | | | | Mat | | | | | |
| | 1 | 2 | 3 | 4 | 5 | 6 | 7 | 8 | 9 | 10 | 11 | 12 |
| Recovery of the cleaner | A | C | B | A | C | C | A | D | A | A | D | A |
| Cleaning efficiency (%) | 63.5 | 43.2 | 28.1 | 74.5 | 58.3 | 48.6 | 68.8 | 45.7 | 31.5 | 71.8 | 51.6 | 41.3 |
| Appearance and touch after cleaning | A | A | D | A | B | F | A | B | D | A | C | D |
| Evaluation from the residual odor after cleaning | A | A | D | A | B | D | A | B | D | A | C | D |
| Evaluation from the degree of soil in one month after cleaning | A | B | D | A | C | D | A | B | D | A | C | D |

A indicates more than 60%
B indicates 50~60%
C indicates 40~50%
D indicates less than 40%

Formulations 1, 4, 7 and 10, the cleaning compositions according to the present invention, were superior to the conventional formulations of the cleaners in all items of the cleaning test.

Having now fully described this invention, it will be apparent to one of ordinary skill in the art that many changes and modifications can be made thereto without departing from the spirit or scope of the invention set forth herein.

What is claimed as new and intended to be covered by Letters Patent of the United States is:

1. A powdered cleaning composition for cleaning in the dry state comprising:

a carrier comprised of 20 to 50 wt. % based on the carrier of an organic fiber having a length of from 110 to 1000 microns and 50 to 80 wt. % based on the carrier of an amino aldehyde resin;

and adsorbed in said carrier at least one surfactant and water wherein said surfactant is present in an amount of 0.01 to 40 wt. % based on the carrier and said water is present in amount of 20 to 250 wt. % based on the carrier.

2. The powdered cleaning composition according to claim 1, further comprising, adsorbed in said carrier, at least one member selected from the group consisting of builder, organic solvent, fluorescent dye, enzyme, bleaching agent and germicide.

3. The powdered cleaning composition according to claim 1, wherein said surfactant is present in an amount of 0.1 to 10 wt% based on the carrier and said water is present in an amount of 50 to 100 wt% based on the carrier.

4. The powdered cleaning composition according to claim 1, wherein said organic fiber has a length of from 110 to 500 microns.

5. The powdered cleaning composition according to claim 1, wherein said organic fiber has a length of from 220 to 700 microns.

6. The powdered cleaning composition according to claim 1, wherein said organic fiber has a length of from 300 to 1000 microns.

7. The powdered cleaning composition according to claim 1, wherein said organic fiber is selected from the group consisting of polyvinyl alcohol, polyamide, acrylic resin, cellulose and rayon.

8. The powdered cleaning composition according to claim 1, wherein said amino-aldehyde resin is prepared from at least one amine selected from the group consisting of urea, melamine, dicyandiamide, ethylene urea, thiourea, benzoguanamine, guanidine, polyethylenepolyamine and m-phenylene diamine.

9. The powdered cleaning composition according to claim 8, wherein said amino-aldehyde resin is prepared from an amine selected from the group consisting of guanidine, polyethylenepolyamine and m-phenylene diamine.

10. The powdered cleaning composition according to claim 1, wherein said amino-aldehyde resin is prepared from at least one aldehyde selected from the group consisting of formaldehyde, acetaldehyde, glyoxal and furfural.

11. The powdered cleaning composition according to claim 1, wherein said amino-aldehyde resin is prepared from urea, melamine and formaldehyde.

12. The powdered cleaning composition according to claim 1, wherein said amino-aldehyde resin has been reacted with sodium bisulfite, sodium secondary phosphite, phenol-sulfonic acid, naphthalenesulfonic acid or sulfonic acid.

13. The powdered cleaning composition according to claim 1, wherein said carrier has an apparent specific gravity of 0.2–0.5 g/cc and a maximum water content of 100–300 wt%.

14. The powdered cleaning composition according to claim 1, wherein said surfactant is anionic, cationic, nonionic or amphoteric.

* * * * *